US006908319B2

(12) United States Patent
Sasame et al.

(10) Patent No.: US 6,908,319 B2
(45) Date of Patent: Jun. 21, 2005

(54) ELECTRICAL CONNECTOR WITH SHUTTER

(75) Inventors: Naotaka Sasame, Saitama (JP); Shinichi Hashimoto, Kawasaki (JP)

(73) Assignee: Tyco Electronics, AMP K.K., Kanagawa (JP)

( * ) Notice: Subject to any disclaimer, the term of this patent is extended or adjusted under 35 U.S.C. 154(b) by 0 days.

(21) Appl. No.: 10/702,261

(22) Filed: Nov. 5, 2003

(65) Prior Publication Data

US 2004/0092145 A1 May 13, 2004

(30) Foreign Application Priority Data

Nov. 5, 2002 (JP) ..... 2002-321474

(51) Int. Cl.[7] ..... H01R 13/44
(52) U.S. Cl. ..... 439/137
(58) Field of Search ..... 439/137, 138, 439/139, 140, 181, 136; 361/220

(56) References Cited

U.S. PATENT DOCUMENTS 5,372,515 A * 12/1994 Miller et al. ..... 439/138
6,601,995 B1 * 8/2003 Harrison et al. ..... 385/77
2001/0031570 A1 10/2001 Horikoshi et al. ..... 439/137
2002/0177336 A1 * 11/2002 Sasame et al. ..... 439/142

FOREIGN PATENT DOCUMENTS

| | | |
|---|---|---|
| EP | 0232792 A1 | 1/1987 |
| JP | 02-207469 | 8/1990 |
| JP | 02207469 | 8/1990 |
| JP | 07045328 | 2/1995 |
| JP | 07-045328 | 2/1995 |

* cited by examiner

*Primary Examiner*—Chandrika Prasad
(74) *Attorney, Agent, or Firm*—Barley Snyder LLC

(57) ABSTRACT

The present invention provides an electrical connector with a plurality of contacts therein and a conductive shutter rotatable between a closed position covering the plurality of contacts and an open position exposing the plurality of contacts. A shield member encircles the plurality of contacts and is configured to make electrical contact with the conductive shutter when the conductive shutter is in the closed position. A mating connector and a connector arrangement are also provided.

15 Claims, 5 Drawing Sheets

ELECTRICAL CONNECTOR WITH SHUTTER

FIELD OF THE INVENTION

The present invention relates to an electrical connector with a shutter covering a mating portion of the connector having a plurality of electrical contacts arranged therein, wherein the shutter is configured to be freely opened and closed by introduction and withdraw of a mating connector.

BACKGROUND OF THE INVENTION

Electrical connectors are used in a wide variety of applications for making electrical contacts within an electrical system or between electrical systems. In a typical arrangement, an electrical connector has a mating portion with a plurality of electrical contacts arranged therein. The mating portion is configured to be fit to a mating connector. When the mating connector is not fit into the mating portion, however, the mating portion is exposed. Thus, foreign matter may enter the exposed mating portion and adhere to the contacts, whereby electrical connection may be interrupted or compromised when the mating portion is fit to the mating connector.

To protect the electrical connector from foreign matter, it may be provided with a shutter that has a pair of shutter members covering the mating portion and configured to freely open and close.

When a mating connector is mated with an electrical connector connected to a circuit board, for example, the mating connector having electric charge may cause electrostatic discharge between the contacts of the electrical connector and the mating connector and may cause damage to components on the circuit board connected to the electrical connector. A conductor connected to the ground line of a circuit board may be disposed in front of the connector contacts to discharge the mating connector. Consequently, electrostatic discharge that may occur during mating is redirected to the conductor.

In view of the above circumstances, it is an object of the invention to provide an electrical connector with a shutter that both prevents foreign matter from adhering to contacts and prevents electrostatic discharge from causing damage to an electronic circuit associated with the electrical connector.

SUMMARY OF THE INVENTION

This and other objects are achieved by an electrical connector with a plurality of contacts therein and a conductive shutter rotatable between a closed position covering the plurality of contacts and an open position exposing the plurality of contacts. A shield member encircles the plurality of contacts and is configured to make electrical contact with the conductive shutter when the conductive shutter is in the closed position.

In an exemplary embodiment of the present invention, an electrical connector with a shutter is provided, including a housing having a mating portion with a plurality of contacts arranged therein. A pair of shutter members, which are rotatably supported by the housing, extend in the direction of the contact arrangement and have edges that are brought together and separated by rotation. At least one of the pair of shutter members is electrically conductive. The shutter members are urged in a direction of bringing the edges close to each other, into a closed position in which the shutter members cover the mating portion and the plurality of contacts therein when the edges are close to each other. The shutter members are rotated to an open position, in which the edges are separated from each other, exposing the mating portion and the plurality of contacts therein. The housing includes a shield member encircling the housing and the plurality of contacts therein. The shield has a protruding piece which is sandwiched between the pair of shutter members when the edges are close to each other.

BRIEF DESCRIPTION OF THE DRAWINGS

Preferred embodiments of the present invention will be described in detail with reference to the following figures, wherein.

DETAILED DESCRIPTION OF THE PREFERRED EMBODIMENTS

According to an exemplary embodiment of the present invention, shown in FIGS. 1–8, an electrical connector is provided with a shutter to both prevent foreign matter from adhering to contacts of the electrical connector and prevent electrostatic discharge from causing damage on an electronic circuit associated with the electrical connector.

Figure 1:
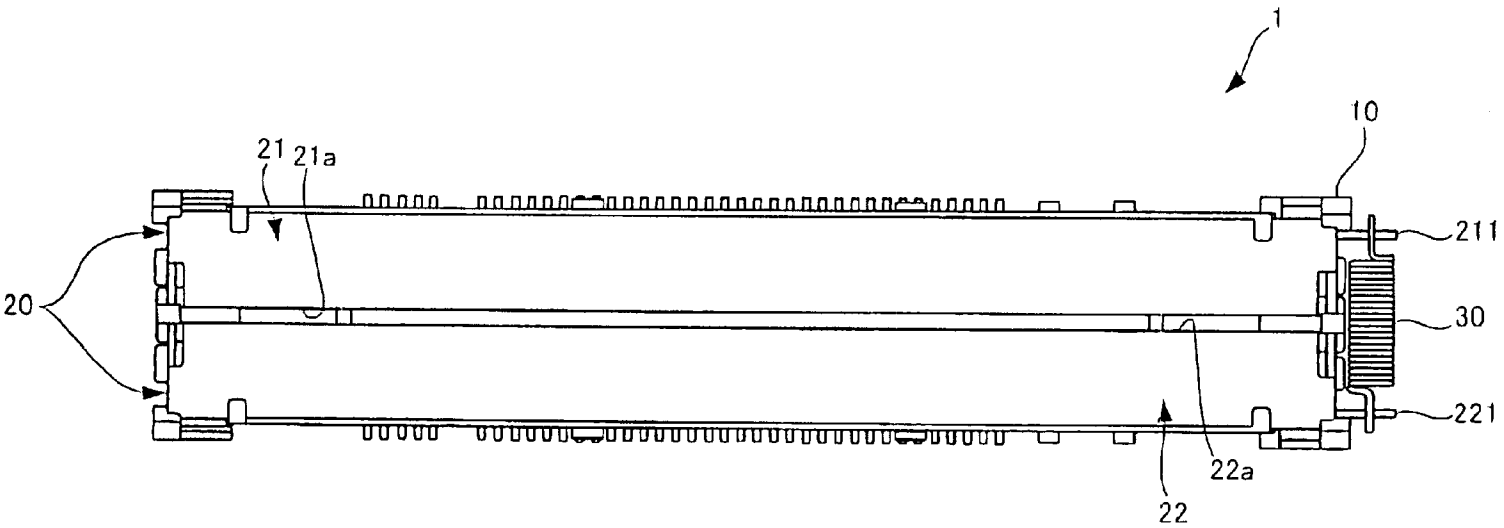
FIG. 1 is plan view showing an electrical connector with a shutter according to an exemplary embodiment of the present invention.
Figure 2:
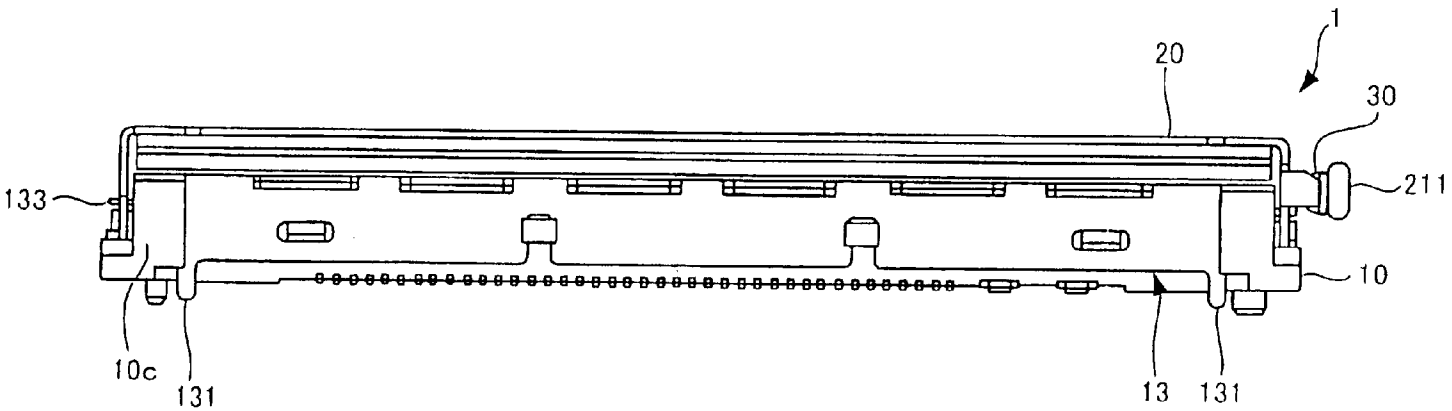
FIG. 2 is a front view of the electrical connector with a shutter of FIG. 1.

An electrical connector 1 is provided with a shutter, as shown in FIG. 1. In the illustrated embodiment, the electrical connector 1 is a surface mount technology (SMT) type connector that is mounted on a surface of a circuit board (not shown). The electrical connector 1 has a housing 10, a pair of shutter members 20, and a biasing member such as spring member 30. The housing 10 has a mating portion 11 wherein a plurality of contacts 100 (shown in FIG. 3) are arranged along the longitudinal direction of the housing 10. The mating portion 11 of the housing 10 is covered with the pair of shutter members 20, as shown in FIG. 2, when there is no mating connector inserted into the mating portion 11 of the electrical connector 1. In the following description, the face of the connector 1 proximate the pair of shutter members 20 as shown in FIG. 1 will be referred to as a front face, and the opposite face, connected, for example, to a circuit board, will be referred to as a rear face.

Figure 3:
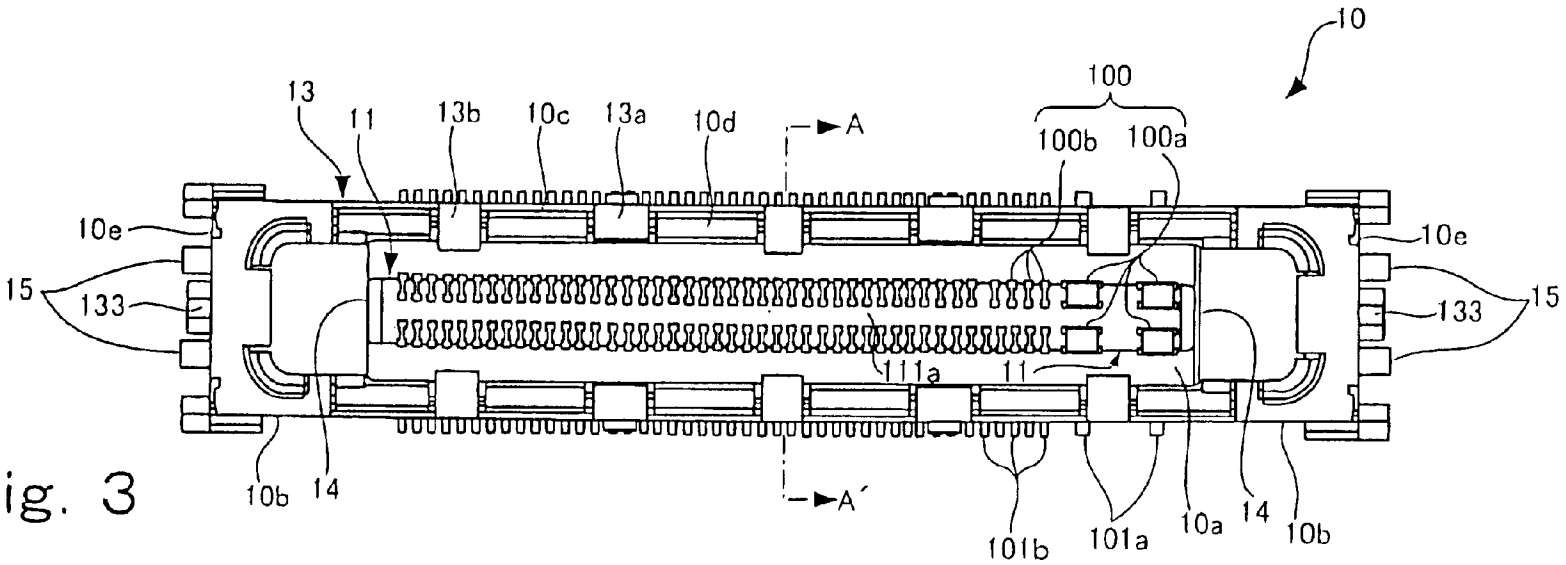
FIG. 3 is a plan view showing a housing provided in the electrical connector with a shutter of FIG. 1.
Figure 4:
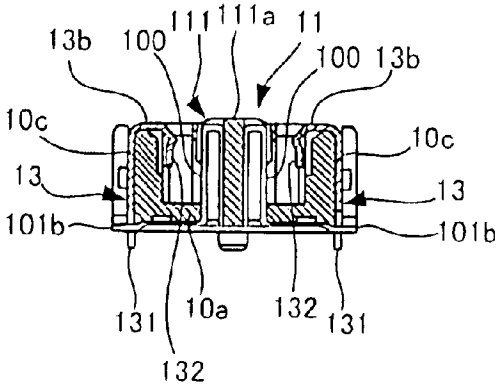
FIG. 4 is a sectional view taken along line A–A' of FIG. 3.

The housing 10 of a preferred embodiment of the electrical connector 1 will next be described in greater detail with reference to FIGS. 3 and 4. FIG. 3 is a plan view showing the housing 10 with the shutter 20 shown in FIGS. 1 and 2 omitted for clarity. FIG. 4 is a sectional view taken along line A–A' of FIG. 3.

As shown in FIG. 4, the housing 10 of FIG. 3 has a mating portion 11 which protrudes from a bottom wall 10*a* toward the front face (upper side of FIG. 4) of the electrical connector. As shown in FIG. 3, the mating portion 11 extends along the longitudinal direction of the housing 10. A plurality of contacts 100 are arranged on both edges extending along the longitudinal direction of the mating portion 11. Of these contacts 100, four contacts 100*a* arranged on the right side of FIG. 3 have legs 101*a* of surface-mounting type that are connected to the power supply line of a circuit board. A number of contacts 100*b* that are provided on the left side of the four contacts 100*a* have legs 101*b* of surface-mounting type that are connected to a signal line of the circuit board.

Further, the housing 10 has a shield member 13 surrounding the housing 10. The shield member 13 is a conductor, which serves to shield the plurality of contacts 100 from surrounding electromagnetic noise. The shield member 13 will be described with reference to FIGS. 2 and 3. The shield member 13 covers both ends 10*b* of the housing 10 at the front face of the connector 1 and a side wall 10*c* provided along the longitudinal direction of the housing 10. As shown in FIG. 4, the shield member 13 has legs 131 which may be connected to the ground line of the circuit board. Moreover, the shield member 13 also has wide portions 13*a* and narrow portions 13*b* that cover portions 10*d* of side wall 10*c*. The portions 10*d* extend along the longitudinal direction of housing 10 at predetermined intervals on the front of the housing. Additionally, the shield member 13 has contact portions 132 shown in FIG. 4. The contact portions 132 are provided from the narrow portion 13*b*, and extend toward the rear side of housing 10. As will be described later, a surface for making contact with the shield member 13 is provided on the mating connector 9 (shown in FIGS. 5 and 6). The contact portions 132 make contact with shield contact surfaces 930 (shown in FIG. 6) of the mating connector 9 when the mating portion 91 (shown in FIG. 6) of the mating connector 9 is fit into the mating portion 11 of the electrical connector 1 with the shutter of FIG. 3. The shield member 13 also has portions covering the front sides of side walls 10*e* extending along the short side of the housing 10, and protruding pieces 133 protrude outward from these portions of the shield member 13. Further, the wide portion 13*a* is bent around side wall 10*c* at the lower wall 10*a* and is brought into contact with the inner surface of side wall 10*c* of the housing 10. With this configuration, even when the contact portions 132 are pressed by the shield members 93 of the mating connector, the shield member 13 may be prevented from expanding outwardly.

The mating portion 11 of connector 1 has a convex portion 111 protruding to the front side in the housing 10. A tip face 111*a* of the convex portion 111 is further forward than the other walls 10*c* and 10*e*. Since the other walls 10*c* and 10*e* are further to the rear of housing 10 than the tip face 111*a*, the rotation of the shutter members 20 is not interrupted by side walls 10*c*, 10*e*. All of the contacts 100 are disposed behind the tip face 111*a*.

Further, as shown in FIG. 3, notched holes 14 are provided on both ends of the bottom wall 10*a* of the housing 10. When connector 1 is mated with the mating connector 9, the mating connector 9 is partly inserted into the notched holes 14. Shafts 15 for rotatably supporting the pair of shutter members 20 are provided on the side walls 10*e* extending along the short side of the housing 10.

Referring again to FIGS. 1 and 2, the pair of shutter members 20 and the spring member 30 will be described below.

The pair of shutter members 20 have a first shutter member 21 and second shutter member 22, at least one of which shutter members 21, 22 is electrically conductive. Both of the shutter members 21 and 22 extend the longitudinal length of housing 10, from one side wall 10*e* to the other side wall 10*e* extending along the short side of the housing 10. The shutter members 21 and 22 are rotatably supported by the shafts 15 (shown in FIG. 3) provided on each of the short side walls 10*e*, respectively. In the pair of shutter members 20, a lower edge 21*a* of the first shutter member 21 and an upper edge 22*a* of the second shutter member 22 are disposed closest to each other at the front face of the mating portion 11 (shown in FIG. 3). The pair of shutter members 20 rotate in the directions such that the lower edge 21*a* of the first shutter member 21 and the upper edge 22*a* of the second shutter member 22 are brought into proximity or contact with each other and conversely so that the edges 21*a*, 22*a* separate from each other, respectively. Namely, in FIG. 1, the first shutter member 21 is rotated in the upward direction of FIG. 1, and the second shutter member 22 is rotated in the downward direction of FIG. 1.

Figure 7:
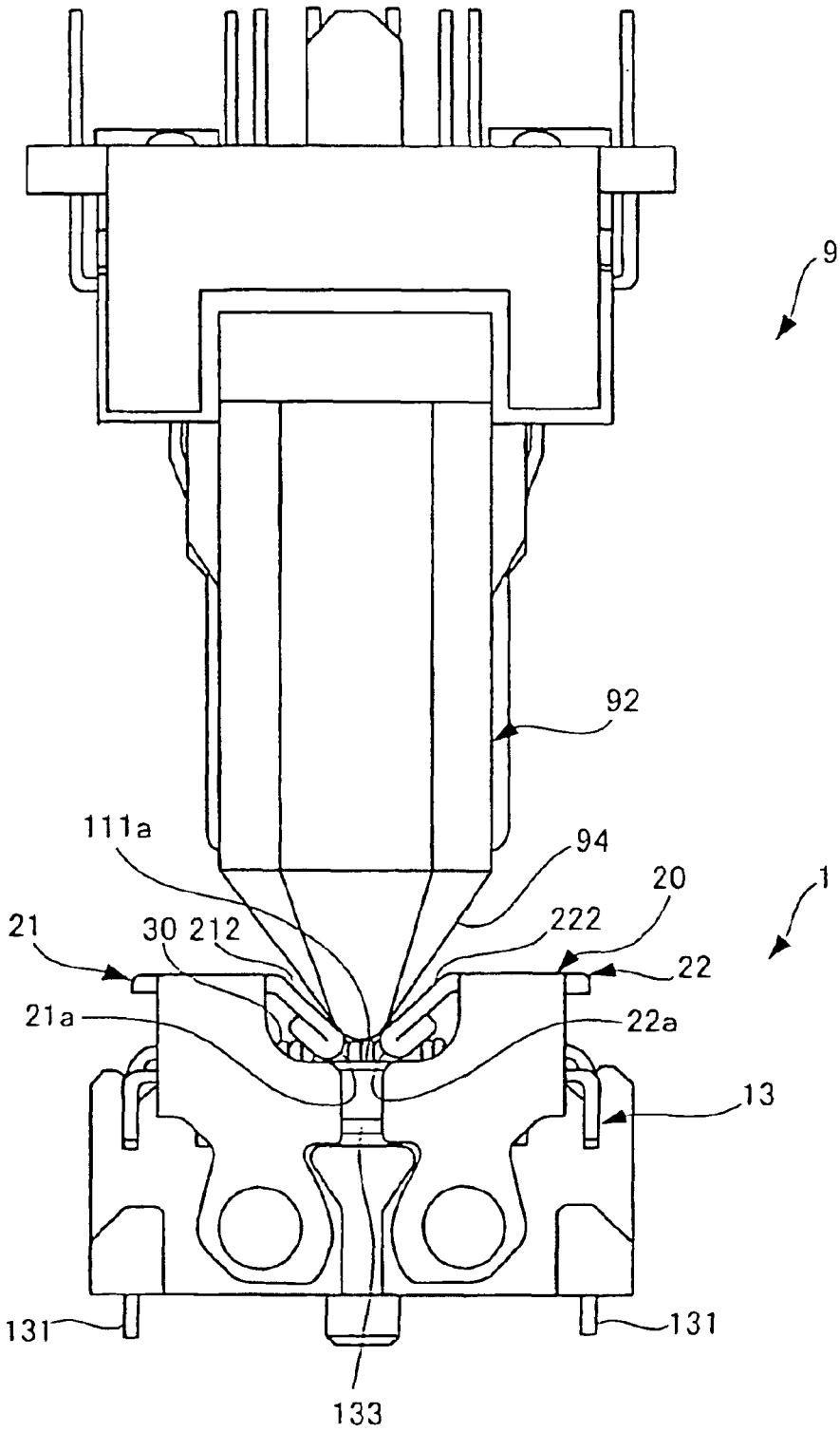
FIG. 7 is a side view showing the mating connector of FIG. 5 and the electrical connector with a shutter of FIG. 1 as they are brought into contact with one another.

As best shown in FIG. 7, the first shutter member 21 is bent along the longitudinal length of first shutter 21, such that a bent portion 212 terminates with the lower edge 21*a* of first shutter member 21 extending toward the rear of housing 10 and into close proximity or contact with the tip face 111*a* of the convex portion 111 of housing 10 when the first shutter member 21 is in the closed position. The second shutter member 22 is bent in a like manner, such that a bent portion 222 terminates with the upper edge 22*a* of lower shutter member 22 extending toward the rear of housing 10 and into close proximity or contact with the tip face 111*a* of the convex portion 111 of housing 10 when the second shutter member 21 is in the closed position.

As shown in FIG. 1, the spring member 30 is disposed adjacent the side wall 10*e* extending along the short side of the housing 10. On the side where the spring member 30 is disposed, a locking portion 211 locking one end of the spring member 30 is provided on the end of the first shutter member 21. On the same side, a locking portion 221 locking the other end of the spring member 30 is provided on the end of the second shutter member 22. The spring member 30 urges the pair of the shutter members 20 toward a closed position, bringing the lower edge 21*a* of the first shutter member 21 and the upper edge 22*a* of the second shutter member 22 toward each other. Therefore, the pair of shutter members 20 are closed except when external force is applied. An advantage of the present invention is that the pair of shutter members are normally closed, thereby preventing foreign material from adhering to the plurality of contacts 100.

Figure 5:
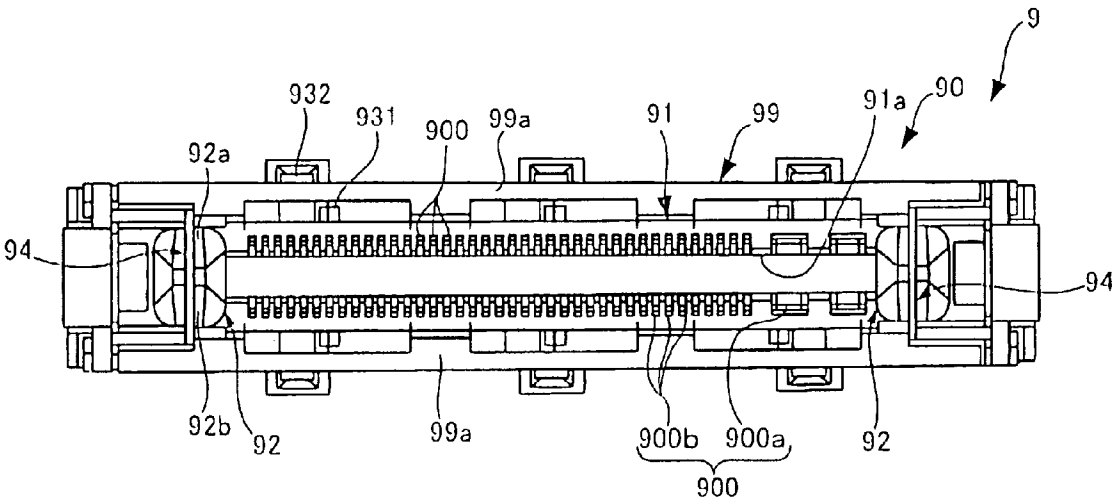
FIG. 5 is a plan view showing a mating connector for mating to the electrical connector with the shutter of FIG. 1.
Figure 6:
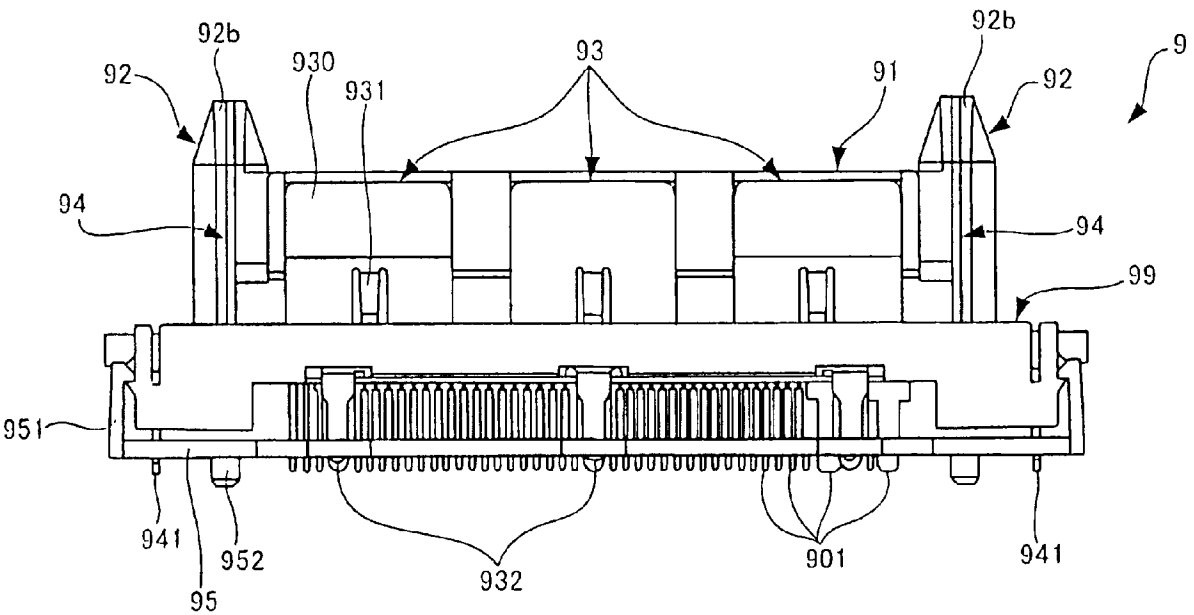
FIG. 6 is a front view of the mating connector of FIG. 5.

The mating connector 9 will next be described with reference to FIGS. 5 and 6. The mating connector 9, shown in FIG. 5, has a housing 90. The housing 90 has a mating portion 91 protruding from a base portion 99. The mating portion 91 has plurality of contacts 900 (900*a*, 900*b*) arranged therein. The contacts 900 correspond to the plurality of contacts 100 of the electrical connector 1 with the shutter (shown in FIG. 1). As shown in FIG. 5, on the mating portion 91, a groove 91*a* is formed which receives the mating portion 11 of the electrical connector 1. As shown in FIG. 6, each of the plurality of contacts 900 has a leg 901 inserted into a through hole of a circuit board. Further, cam members 92 protruding in the mating direction are provided on both sides of the mating portion 91. The cam member 92 has a tapered shape which is defined by tapered faces 92*a* and 92*b* so as to substantially coincide with a space between the bent portion 212 of the first shutter member 21 and the bent portion 222 of the second shutter member 22. The housing 90 has shield members 93 similar to the shield member 13 of the electrical connector 1. Contact surfaces 930 are provided on shield members 93 at positions corresponding to the contact portions 132 (FIG. 4) provided on the shield member 13 of the electrical connector 1. The shield member 93 has a plurality of legs 932, which may be connected to the ground line of a circuit board. Raised pieces 931 are provided on the shield member 93. The raised pieces 931 make contact with an opening edge of a panel (not shown) where the mating connector 9 is attached.

Further, the housing 90 has two conductive members 94. As shown in FIG. 6, the conductive members 94 each have a leg 941, which may be connected to the ground line of a circuit board. The conductive member 94 is a conductor which extends from the leg 941 to the tapered face 92*a* of the cam member 92, passes through the tapered face 92*b* via the tip of the cam member 92, and returns to the leg 941. A guide plate 95 arranging the legs 901 of the plurality of contacts 900 is attached to the bottom of the housing 90. Latch arms 951 temporarily and securely locking the guide plate 95 to the housing 90 are provided on both ends in the longitudinal direction of the guide plate 95 (FIG. 6 shows a temporary locking state). Bosses 952 protrude from the bottom of the guide plate 95. The bosses 952 position the guide plate 95 on a substrate (not shown) where the mating connector 9 is mounted.

The process of mating the mating connector 9 to the electrical connector 1 having a shutter will next be described with reference to FIGS. 7 and 8.

In the electrical connector 1, the pair of shutter members 20 is closed before the electrical connector 1 is fit into the mating connector 9 of FIG. 5. The protruding piece 133 provided on the shield member 13 is sandwiched between the first shutter member 21 and the second shutter member 22. Therefore, the electrical connector 1 with the shutter in the closed state as illustrated in FIG. 7 forms a current path including: at least one of the pair of shutter members 20, the protruding piece 133, and the leg 131. Further, when the pair of the shutter members 20 is closed, the lower edge 21*a* of the first shutter member 21 and the upper edge 22*a* of the second shutter member 22 are in contact with the tip face 111*a* on the convex portion of the mating portion 11. Even when the pair of shutter members 20 is pressed by an external foreign matter toward the rear of housing 10, the pair of shutter members 20 are supported by the tip face 111*a*, preventing deformation or movement of the pair of shutter members 20, and consequently preventing contact of the foreign matter with the plurality of contacts 100. Moreover, the convex portion provides an air gap between the pair of closed shutter members 20 and the plurality of contacts 100 of the electrical connector 1, thereby increasing the arcing threshold voltage between the shutter members 20 and the plurality of contacts 100.

Figure 8:
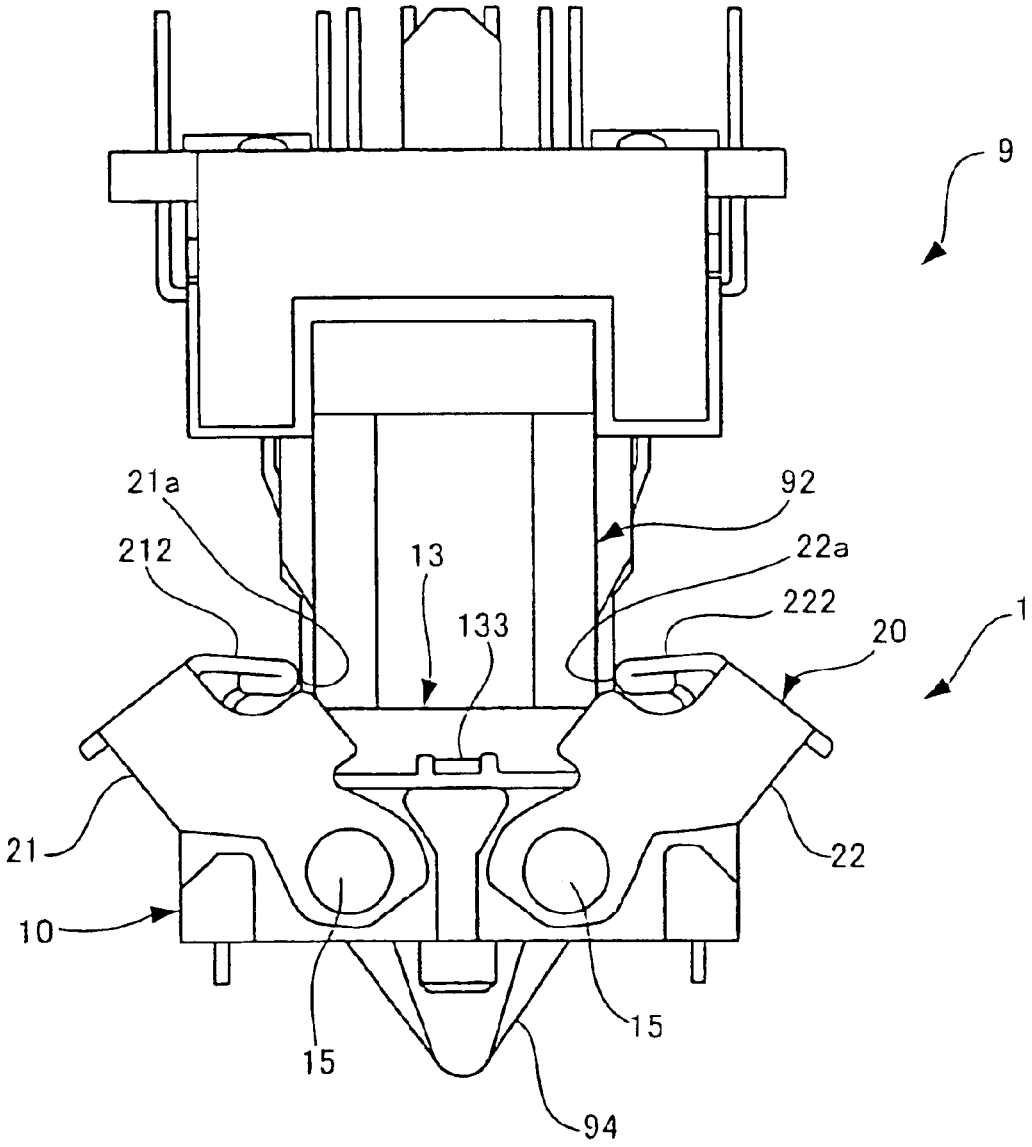
FIG. 8 is a side view showing the mating connector of FIG. 5 and the electrical connector with a shutter of FIG. 1 as the mating connector is inserted into the electrical connector with a shutter.

In a connector arrangement, as shown in FIGS. 7 and 8, the mating connector 9 is brought into contact with the electrical connector 1 in order to mate the connector 9 with the electrical connector 1. The tips of the cam members 92 of the mating connector 9 are initially brought into contact with the pair of shutter members 20 provided on the electrical connector 1. The conductive member 94, passing over the tip of the cam member 92 of the mating connector 9, makes electrical contact with at least one conductive shutter member 20 of the electrical connector 1. The shutter members 21 and 22 are in contact with the protruding piece 133 of the shield member 13. Thus, electrostatic discharge, which might otherwise occur between the electrical connector 1 and the mating connector 9, is instead directed from the conductive member 94 of mating connector 9 through at least one conductive shutter member 20 into the protruding piece 133 of shield 13. Therefore, discharge current does not flow into components on a circuit board where the electrical connector 1 is mounted. Hence, it is possible to prevent electrostatic discharge from causing damage to a component of a circuit board.

When the mating connector 9 is inserted into the electrical connector 1, as shown in FIG. 8, the pair of shutter members 20 are pressed by the cam members 92 and are rotated around the shafts 15 provided in the housing 10. Namely, in FIG. 8, the first shutter member 21 starts rotating counterclockwise and the second shutter member 22 starts rotating clockwise while going against the urging force of the spring member 30 (partly shown in FIG. 7). When the pair of shutter members 20 starts rotating, the lower edge 21*a* of the first shutter member 21 and the upper edge 22*a* of the second shutter member 22 start separating from each other, leading to exposure of the mating portion 11 (not shown in FIG. 8) of the electrical connector 1 to the mating connector 9. Further, both of the shutter members 21 and 22 start separating from the protruding pieces 133 of the shield member 13.

Then, when the insertion of the mating connector 9 continues until the mating portion of the mating connector 9 is fit into the mating portion of the electrical connector 1, the cam members 92 of the mating connector 9 are positioned in the notched holes 14 of the housing 10 in the electrical connector 1. When the mating portion of the electrical connector 1 and the mating portion of the mating connector 9 are fit to each other, the pair of shutter members 20 are rotated until bent portions 212, 222 (FIG. 8) of the shutter members 21 and 22 overlap the portions 10*d* of side walls 10*c* extending along the longitudinal direction at the front of the housing 10 (shown in FIG. 3). Base peripheral walls 99*a* (FIG. 5) of the mating connector 9 are in contact with the bent portions 212 and 222 of the shutter members 21 and 22. Thus, the pair of shutter members 20 are held open until the mating connector 9 is removed.

As described above, according to the electronic connector with the shutter of the present invention, it is possible to prevent a foreign matter from adhering to the contacts and prevent electrostatic discharge from causing damage to an electronic circuit at a connecting destination.

What is claimed is:

1. An electrical connector comprising:

a conductive shutter rotatable between a closed position covering a plurality of contacts within the electrical connector and an open position exposing the plurality of contacts;

a grounded shield member encircling the plurality of contacts and configured to make electrical contact with the conductive shutter when the conductive shutter is in the closed position; and a housing with a mating portion supporting the plurality of contacts and having side walls surrounding the mating portion, the mating portion having a convex portion protruding toward the front face more than the side walls of the housing.

2. The electrical connector with a shutter according to claim 1, wherein the shutter comprises a pair of shutter members having edges that are brought into close proximity or contact with the convex portion when the pair of shutter members are in the closed position.

3. The electrical connector with a shutter according to claim 2 wherein each of the pair of shutter members have a bent portion terminating with an edge thereof extending away from the front face of the connector and into close proximity with the convex portion.

4. The electrical connector with a shutter according to claim 1, wherein the shield member includes legs extending from the housing for electrical connection to a grounding source.

5. The electrical connector with a shutter according to claim 4, wherein the electrical connector is mounted on a circuit board and the grounding source is a ground line of the circuit board.

6. An electrical connector with a shutter, the connector comprising:

a housing having a mating portion with a plurality of contacts therein;

a pair of shutter members disposed at a front face of the electrical connector, the pair of shutters being rotatably supported by the housing and rotatable between a closed position covering the plurality of contacts and an open position exposing the plurality of contacts, at least one of the pair of shutter members being electrically conductive; and a biasing device urging the pair of shutter members toward the closed position;

the housing including a shield member encircling the housing and having a protruding piece which is disposed in a position making electrical contact with the at least one conductive shutter when the pair of shutter members are in the closed position wherein the housing comprises side walls surrounding the mating portion and the mating portion has a convex portion protruding toward the front face more than the side walls of the housing.

7. The electrical connector with a shutter according to claim 6, wherein the pair of shutter members have edges that are brought into close proximity or contact with the convex portion when the pair of shutter members are in the closed position.

8. The electrical connector with a shutter according to claim 6 wherein each of the pair of shutter members have a bent portion terminating with an edge thereof extending away from the front face of the connector and into close proximity with the convex portion.

9. The electrical connector with a shutter according to claim 6 wherein each of the pair of shutter members have a bent portion terminating with an edge thereof extending away from the front face of the connector and into contact with the convex portion.

10. An electrical connector with a shutter, comprising:

a housing having a mating portion with a plurality of contacts therein;

a pair of shutter members disposed at a front face of the electrical connector, the pair of shutters being rotatably supported by the housing and rotatable between a closed position covering the plurality of contacts and an open position exposing the plurality of contacts, at least one of the pair of shutter members being electrically conductive; and a biasing device urging the pair of shutter members toward the closed position;

the housing including a shield member encircling the housing and having a protruding piece which is disposed in a position making electrical contact with the at least one conductive shutter when the pair of shutter members are in the closed position;

wherein the shield member includes legs extending from the housing for electrical connection to a grounding source.

11. The electrical connector with a shutter according to claim 10, wherein the electrical connector is mounted on a circuit board and the grounding source is a ground line of the circuit board.

12. A mating connector for connecting with an electrical connector with a conductive shutter, the mating connector comprising:

a plurality of contacts for making electrical connections with contacts in the electrical connector with a conductive shutter;

a tapered cam member extending in a mating direction of the mating connector for opening the conductive shutter; and a conductive member extending to a tip of the tapered cam member for forming an electrostatic discharge path with the conductive shutter;

wherein the tapered cam member is configured to substantially coincide with a space between bent portions of the conductive shutter.

13. A connector arrangement comprising:

an electrical connector having a plurality of contacts, at least one conductive shutter member disposed thereon rotatable between a closed position covering the plurality of contacts and an open position exposing the plurality of contacts, and a grounded shield member encircling the plurality of contacts and configured to make electrical contact with the at least one conductive shutter member in the closed position; and a mating connector having a plurality of contacts for making electrical connections with contacts in the electrical connector, a tapered cam member extending in a mating direction of the mating connector for opening the shutter, and a conductive member extending to a tip of the tapered cam member for forming an electrostatic discharge path with the shutter;

wherein the electrical connector comprises a housing with a mating portion supporting the plurality of contacts and having side walls surrounding the mating portion, the mating portion having a convex portion protruding toward the front face more than the side walls of the housing, and the shutter comprises a pair of shutter members having edges that are brought into close proximity or contact with the convex portion when the pair of shutter members are in the closed position.

14. The connector arrangement according to claim 13, wherein each of the pair of shutter members have a bent portion terminating with an edge thereof extending away from the front face of the connector and into close proximity with the convex portion.

15. The connector arrangement according to claim 14, wherein the tapered cam member is configured to substantially coincide with a space between bent portions of the conductive shutter.

* * * * *

UNITED STATES PATENT AND TRADEMARK OFFICE

CERTIFICATE OF CORRECTION

PATENT NO. : 6,908,319 B2
DATED : June 21, 2005
INVENTOR(S) : Sasame et al.

It is certified that error appears in the above-identified patent and that said Letters Patent is hereby corrected as shown below:

Column 8,
Line 12, "A mating connector for connecting" should read -- A mating connector for connection --.

Signed and Sealed this

Fourteenth Day of February, 2006

JON W. DUDAS
*Director of the United States Patent and Trademark Office*